US010488875B1

(12) United States Patent
Olieman et al.

(10) Patent No.: US 10,488,875 B1
(45) Date of Patent: Nov. 26, 2019

(54) DUAL LOOP LOW DROPOUT REGULATOR SYSTEM

(71) Applicant: NXP B.V., Eindhoven (NL)

(72) Inventors: Erik Olieman, Waalre (NL); Alphons Litjes, Zijtaart (NL); Ibrahim Candan, Eindhoven (NL)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 16/108,387

(22) Filed: Aug. 22, 2018

(51) Int. Cl.
*G05F 1/575* (2006.01)
*G05F 1/46* (2006.01)
*G05F 1/565* (2006.01)

(52) U.S. Cl.
CPC ..... *G05F 1/461* (2013.01); *G05F 1/565* (2013.01); *G05F 1/575* (2013.01)

(58) Field of Classification Search
CPC ..... G05F 1/461; G05F 1/4626; G05F 1/565; G05F 1/575
See application file for complete search history.

(56) References Cited

U.S. PATENT DOCUMENTS 5,283,514 A * 2/1994 Hayward ..... G05F 1/575 323/273
6,765,374 B1 * 7/2004 Yang ..... G05F 1/575 323/280
6,856,124 B2 * 2/2005 Dearn ..... G05F 1/575 323/273
7,253,595 B2 8/2007 Oddoart et al.
10,234,881 B1 * 3/2019 Goyal ..... G05F 1/575
2005/0073286 A1 * 4/2005 Ke ..... G05F 1/575 323/280
2006/0108993 A1 * 5/2006 Chien ..... G05F 1/565 323/282
2006/0181258 A1 * 8/2006 Benbrik ..... G05F 1/565 323/315
2008/0174289 A1 * 7/2008 Gurcan ..... G05F 1/575 323/280
2008/0191670 A1 8/2008 Oddoart et al.
2009/0121912 A1 * 5/2009 Zanchi ..... H03M 1/0863 341/172
2011/0001458 A1 * 1/2011 Bansal ..... G05F 1/575 323/282

(Continued)

OTHER PUBLICATIONS

Liu, C., "A 12 bit 100 MS/s SAR-Assisted Digital-Slope ADC" IEEE Journal of Solid-State Circuits, vol. 51, No. 12, Dec. 2016.

(Continued)

*Primary Examiner* — Fred E Finch, III

(57) ABSTRACT

A low dropout (LDO) regulator system is provided. The LDO regulator system includes a first amplifier circuit, a second amplifier circuit, and a switch circuit. The first amplifier circuit has a first input coupled to receive a reference voltage and an output. The second amplifier circuit has a first input coupled to the output of the first amplifier and is configured to provide a predetermined voltage at a first output. The switch circuit is coupled between the first output of the second amplifier circuit and a second input of the first amplifier circuit and is configured to cause an open circuit in a first feedback path from the first output of the second amplifier circuit to the second input of the first amplifier circuit based on a control signal.

20 Claims, 4 Drawing Sheets

(56) References Cited

U.S. PATENT DOCUMENTS

| | | | | |
|---|---|---|---|---|
| 2011/0316506 | A1* | 12/2011 | Bulzacchelli | G05F 1/575 323/282 |
| 2012/0062197 | A1* | 3/2012 | Luders | G05F 1/563 323/282 |
| 2012/0299564 | A1* | 11/2012 | Howes | G05F 1/575 323/281 |
| 2012/0313597 | A1* | 12/2012 | Hunter | G05F 1/575 323/280 |
| 2015/0192943 | A1* | 7/2015 | Roham | G05F 1/575 323/273 |
| 2016/0173066 | A1* | 6/2016 | Yang | H03K 19/0013 327/109 |
| 2017/0083033 | A1 | 3/2017 | Park et al. | |
| 2018/0107232 | A1* | 4/2018 | Yung | G05F 1/575 |
| 2019/0033902 | A1* | 1/2019 | Enjalbert | H03K 17/22 |
| 2019/0146532 | A1* | 5/2019 | Ballarin | G05F 1/575 323/283 |

OTHER PUBLICATIONS

Wang, L., "A Fast Transient LDO Based on Dual Loop FVF with High PSRR", APCCAS 2016, IEEE 2016.

* cited by examiner

400

DUAL LOOP LOW DROPOUT REGULATOR SYSTEM

BACKGROUND

Field

This disclosure relates generally to electronic circuits, and more specifically, to a dual loop low dropout (LDO) regulator system.

Related Art

Today, many microcontrollers and systems-on-a-chip (SoC) devices incorporate voltage regulators. Such voltage regulators are commonly used to provide a stable voltage to load circuits such as custom switching logic, memories, analog circuits, and so on. These load circuits can draw a significant amount of peak currents and affect the response and accuracy of the voltage provided by the regulators. Therefore, a need exists for a voltage regulator system that improves voltage response and accuracy when supplying peak currents.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

Generally, there is provided, a dual loop low dropout (LDO) regulator system having a feedback path conditionally enabled. The dual loop LDO provides a predetermined output voltage and includes a fast loop for fast settling of the output voltage and a slow loop for accurately setting the output voltage. The slow loop incorporates a switch circuit in the feedback path which is enabled when the output voltage is within a predetermined range of the predetermined output voltage value allowing the fast loop to be optimized for speed while providing an accurate output voltage.

Figure 1:
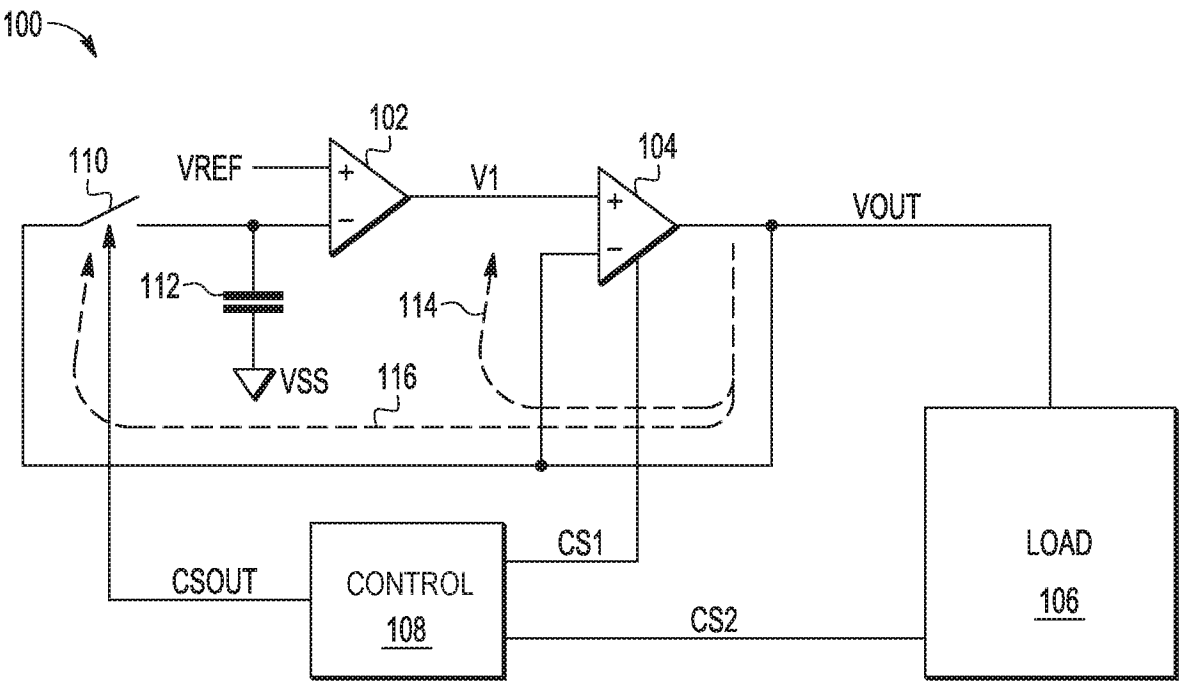
FIG. 1 illustrates, in simplified block diagram form, an example dual loop low dropout (LDO) regulator system in accordance with an embodiment.

FIG. 1 illustrates, in simplified block diagram form, an example dual loop low dropout (LDO) regulator system 100 in accordance with an embodiment. System 100 includes cascaded arrangement of a first amplifier stage 102 and a second amplifier stage 104 coupled to a load circuit 106 by way of an output node labeled VOUT. A logic control circuit 108 is coupled to receive output control signals CS1, CS2 from the second amplifier stage 104 and the load circuit 106 and provide a control signal CSOUT to a switch circuit 110 coupled at an input of the first amplifier stage 102.

The first amplifier stage 102 of system 100 is implemented as an operational amplifier having a non-inverting input (+) coupled to receive a reference voltage labeled VREF, an inverting input (−) coupled to the output node by way of a first feedback path 116, and an output coupled to provide an output voltage signal V1 to the second amplifier stage 104 at node labeled V1. The first feedback path 116 includes switch circuit 110 coupled in the path from VOUT to the inverting input of the operational amplifier. When the control signal CSOUT is at a first state (e.g., logic low level), the switch circuit is configured to cause a short circuit providing a contiguous conductive first feedback path 116. When CSOUT is at a second state (e.g., logic high level), the switch circuit is configured to open causing an open circuit in the first feedback path 116 and inhibits the VOUT signal from reaching the inverting input. A capacitor 112 is coupled at the inverting input to hold a voltage level when the first feedback path 116 is open. The first feedback path 116 along with the first amplifier stage 102 form a first loop characterized as a slow loop. When enabled (e.g., switch circuit 110 closed), the slow loop serves to accurately set the output voltage to a predetermined VOUT value.

The second amplifier stage 104 of system 100 is implemented as a low DC gain, fast settling amplifier including an activity detection circuit. The second amplifier stage 104 includes a non-inverting input (+) coupled to receive output voltage signal V1, an inverting input (−) coupled to the output node by way of a second feedback path 114, a first output coupled to provide a regulated output voltage VOUT to the load circuit 106 at node labeled VOUT, and a second output coupled to provide control signal CS1 to logic control circuit 108. The second feedback path 114 along with the second operational amplifier form a second loop characterized as a fast loop. The fast loop serves to quickly settle the output voltage to the predetermined VOUT value. The CS1 signal provides a fast loop active indication (e.g., second operational amplifier sourcing or sinking current). In an embodiment, the CS1 signal provides an indication that the second amplifier stage 104 is sourcing or sinking current at or beyond a predetermined threshold (e.g., approximately 10% of a maximum source or sink current value of the second operational amplifier). For example, if the maximum source current value of the second operational amplifier is approximately 1.0 milliamp, then the CS1 signal provides an active indication when predetermined threshold value of approximately 100 microamps is met or exceeded. In other embodiments, other threshold values may be chosen. In some embodiments, the second feedback path 114 may be implemented within the circuitry of the second amplifier stage 104.

The load circuit 106 of system 100 includes an input coupled to receive regulated voltage VOUT and an output coupled to provide control signal CS2 to logic control circuit 108. The CS2 signal provides a load circuit active indication (e.g., load circuit switching/operating activity). The load circuit 106 may include any switching circuitry (e.g., digital-to-analog converter (DAC) circuits, switched-capacitor circuits) which requires a regulated voltage (e.g., VOUT) having an accurate settling behavior. In an embodiment, the load circuit 106 of system 100 is a capacitive DAC of a successive approximation register (SAR) analog-to-digital converter (ADC).

The logic control circuit 108 includes a first input coupled to receive control signal CS1, a second input coupled to receive control signal CS2, and an output coupled to provide control signal CSOUT to switch circuit 110. The logic control circuit 108 may include one or more logic gates (e.g., OR gate) or combinational logic. The logic control circuit 108 is configured to provide control signal CSOUT based on input control signals CS1 and CS2. For example, when both CS1 and CS2 signals are inactive (e.g., logic low level), the CSOUT signal is at a first state (e.g., logic low level) causing the switch circuit 110 to close, completing a conduction path (e.g., first feedback path 116) from VOUT to the inverting input (−) of the first amplifier stage 102. When either CS1 or CS2 signals are active (e.g., logic high level), the control signal CSOUT is at a second state (e.g., logic high level) causing the switch circuit to open which results in an open circuit in the first feedback path 116. In an embodiment, the switch circuit is implemented as P-channel transistor having a control electrode coupled to receive the CSOUT signal. In another embodiment, the switch circuit may be implemented as a transmission gate having a P-channel transistor and an N-channel transistor connected in a parallel arrangement. With this arrangement, control electrodes of the P-channel and N-channel transistors are coupled to receive the CSOUT signal and a complement of the CSOUT signal, respectively. In other embodiments, switch circuit 110 may be implemented using other circuit configurations.

Figure 2:
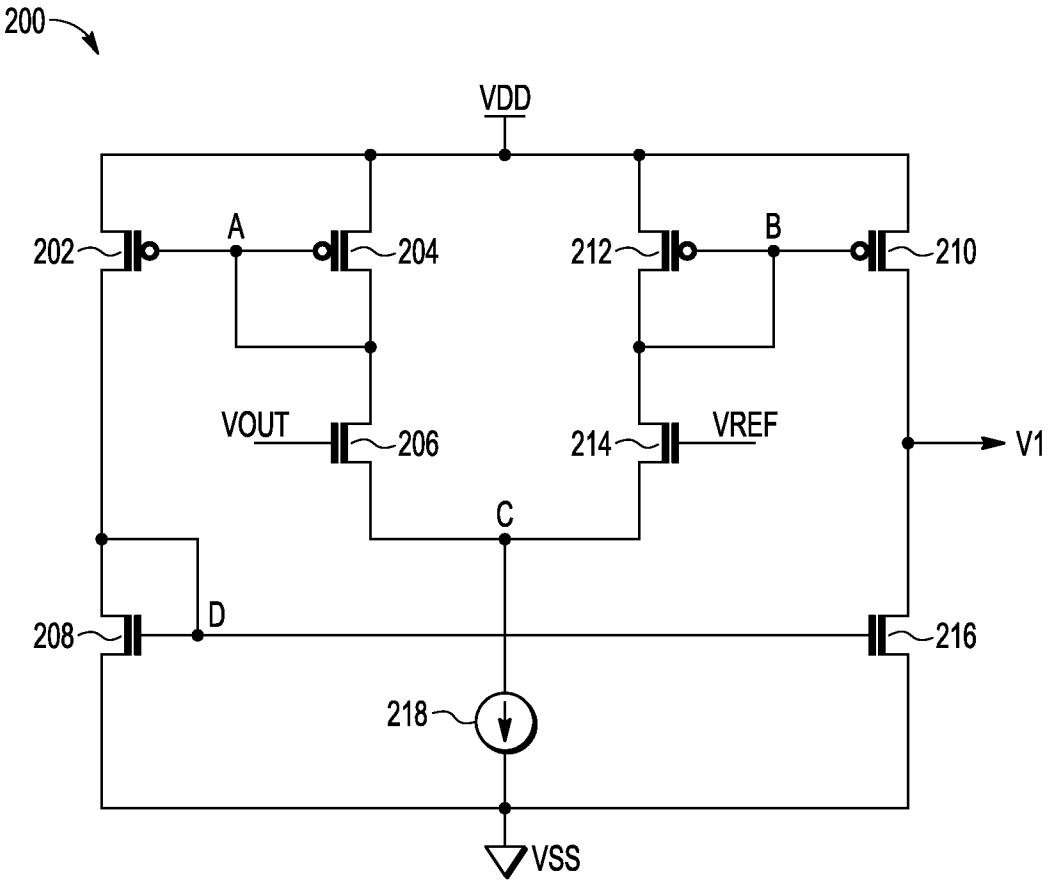
FIG. 2 illustrates, in simplified schematic diagram form, an example implementation of first amplifier stage 102 of FIG. 1 in accordance with an embodiment.

FIG. 2 illustrates, in simplified schematic diagram form, an example implementation of the first amplifier stage 102 of FIG. 1 in accordance with an embodiment. The first amplifier stage circuitry 200 includes a non-inverting input coupled to receive a reference voltage labeled VREF, an inverting input coupled to receive a feedback voltage labeled VOUT (e.g., when switch circuit 110 is closed), and an output coupled to provide output voltage labeled V1. In an embodiment, the first amplifier stage circuitry 200 includes P-channel transistors 202-204, 210-212, N-channel transistors 206-208, 216-218, and current source 218.

Transistors 202 and 204 are configured to form a first current mirror having a first current branch and a second current branch. A first current electrode of each of transistors 202 and 204 is coupled to a first voltage supply terminal (e.g., VDD). A second current electrode of transistor 202 is coupled to a first current electrode and control electrode of transistor 208 in the first current branch and a control electrode of transistor 216 at node labeled D. A second current electrode of transistor 204 is coupled to control electrodes of transistors 202, 204 at node labeled A and a first current electrode of transistor 206 in the second current branch. A control electrode of transistor 206 serves as the inverting input of first amplifier stage circuitry 200 and is coupled to receive the feedback voltage VOUT when switch circuit 110 is closed.

Transistors 210 and 212 are configured to form a second current mirror having a third current branch and a fourth current branch. A first current electrode of each of transistors 210 and 212 is coupled to the first voltage supply terminal. A second current electrode of transistor 210 is coupled to a first current electrode of transistor 216 in the third current branch at output node labeled V1. A second current electrode of transistor 212 is coupled to control electrodes of transistors 210 and 212 at node labeled B and a first current electrode of transistor 214 in the fourth current branch. A control electrode of transistor 214 serves as the non-inverting input of first amplifier stage circuitry 200 and is coupled to receive the reference voltage VREF. A second current electrode of each of transistors 206 and 214 is coupled to a first terminal of current source 218 at node labeled C. A second current electrode of each of transistors 208 and 216 and a second terminal of current source 218 are coupled to a second voltage supply terminal (e.g., VSS).

Figure 3:
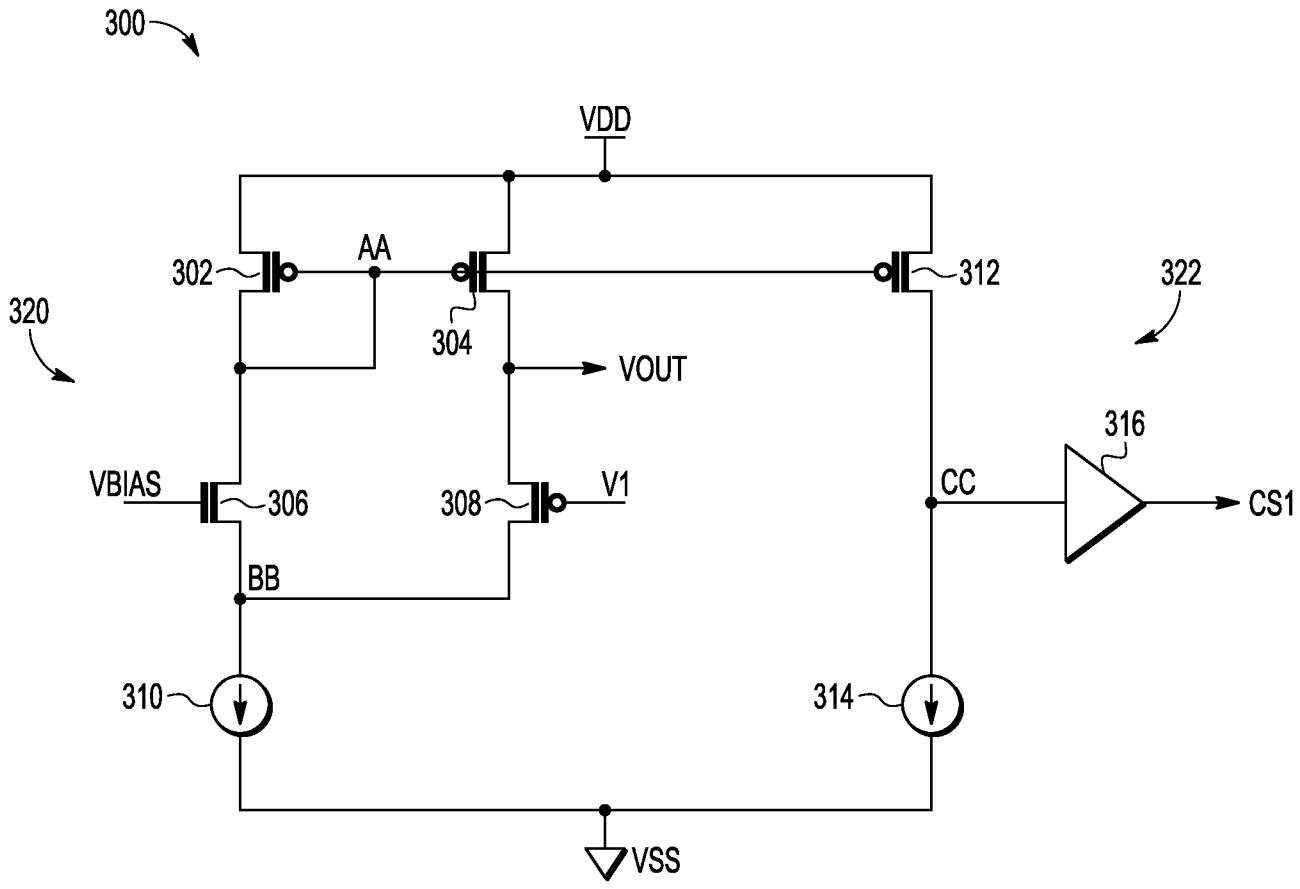
FIG. 3 illustrates, in simplified schematic diagram form, an example implementation of second amplifier stage 104 of FIG. 1 in accordance with an embodiment.

FIG. 3 illustrates, in simplified schematic diagram form, an example implementation of the second amplifier stage 104 of FIG. 1 in accordance with an embodiment. Second amplifier stage circuitry 300 includes an amplifier portion 320 and an activity detection portion 322. The activity detection portion 322 is configured to provide an active indication signal (CS1) when the amplifier portion 320 is sourcing or sinking current. In an embodiment, the second amplifier stage circuitry 300 includes a non-inverting input coupled to receive the V1 voltage signal generated by the first amplifier stage 102, a bias input coupled to receive a bias voltage labeled VBIAS, a first output coupled to provide output voltage VOUT, and a second output coupled to provide the activity indication signal CS1. In an embodiment, the amplifier portion 320 of the second amplifier stage circuitry 300 includes P-channel transistors 302-304, 308, N-channel transistor 306, and current source 310. The activity detection portion 322 of the second amplifier stage circuitry 300 includes P-channel transistor 312, current source 314, and buffer circuit 316.

In the amplifier portion 320, transistors 302 and 304 are configured to form a current mirror having a first current branch and a second current branch. A first current electrode of each of transistors 302 and 304 is coupled to a first voltage supply terminal (e.g., VDD). A second current electrode of transistor 304 is coupled to a first current electrode of transistor 308 in the first current branch at output node labeled VOUT. A second current electrode of transistor 302 is coupled to control electrodes of transistors 302 and 304 at node labeled AA and a first current electrode of transistor 306 in the second current branch. A control electrode of transistor 306 is coupled to receive a bias voltage labeled VBIAS. In an embodiment, the circuit for providing the VBIAS voltage (not shown) is included within the second amplifier stage circuitry 300. In other embodiments, the circuit for providing the VBIAS voltage may be located outside of the second amplifier stage circuitry 300. A control electrode of transistor 308 serves as the non-inverting input of the second amplifier stage circuitry 300 and is coupled to receive the V1 voltage signal. A second current electrode of each of transistors 306 and 308 is coupled to a first terminal of current source 310 at node labeled BB. A second terminal of current source 310 is coupled to a second voltage supply terminal (e.g., VSS).

In the activity detection portion 322, a first current electrode of transistor 312 is coupled to the first voltage supply terminal and a control electrode of transistor 312 is coupled to the amplifier portion at node AA. A second current electrode of transistor 312 is coupled to a first terminal of current source 314 and an input of buffer circuit 316 at node labeled CC. A second terminal of current source 314 is coupled to the second voltage supply terminal. An output of buffer circuit 316 provides the activity indication signal CS1.

In the embodiment depicted in FIG. 3, a feedback path (e.g., second feedback path 114) is essentially formed within the second amplifier stage circuitry 300. The control electrode of transistor 308 serves as the non-inverting input (+) of the second amplifier stage circuitry 300 coupled to receive the V1 voltage signal and the first current electrode of transistor 308 (e.g., source) serves as the inverting input (−) coupled to receive the VOUT voltage signal, thus forming the feedback path. The amplifier portion 320 including the feedback path form a loop characterized as a fast loop (e.g., fast loop formed by second feedback path 114 along with the second amplifier stage 104 of FIG. 1). The fast loop serves to quickly settle the output voltage to a predetermined VOUT value.

The CS1 signal provides a fast loop active indication (e.g., amplifier portion 320 sourcing or sinking current). In an embodiment, the CS1 signal provides an indication that the amplifier portion 320 of the second amplifier stage circuitry 300 is sourcing or sinking current at or beyond a predetermined threshold. In an embodiment, the threshold value is approximately 10% of a maximum source or sink current value of the amplifier portion 320 of the second amplifier stage circuitry 300. For example, if the maximum source current value of the amplifier portion 320 is approximately 1.0 milliamp, then the CS1 signal provides an active indication (e.g., logic high level signal) when predetermined threshold value of approximately 100 microamps is met or exceeded. In other embodiments, other threshold values may be chosen. In some embodiments, the second feedback path 114 may be implemented within the circuitry of the second amplifier stage circuitry 300.

Figure 4:
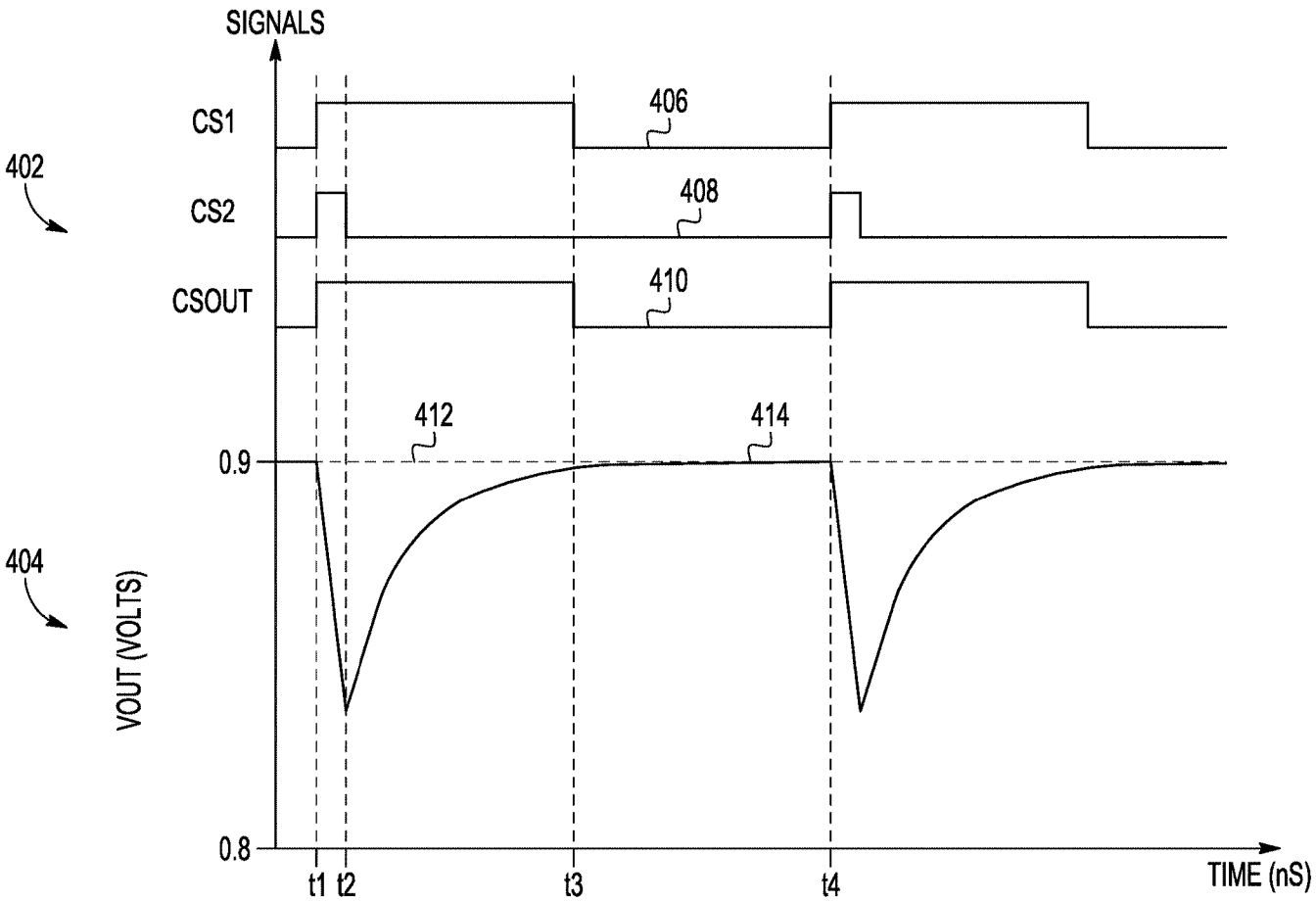
FIG. 4 illustrates, in plot diagram form, an example simulation result and control signal timing of the dual loop LDO system of FIG. 1 in accordance with an embodiment.

FIG. 4 illustrates, in plot diagram form, an example simulation result and control signal timing of the dual loop LDO system 100 of FIG. 1 in accordance with an embodiment. The plot diagram 400 includes control signal timing 402 and corresponding VOUT simulation response 404. The control signal timing 402 shows control signals CS1, CS2, and CSOUT having respective waveforms 406, 408, and 410 during normal operation of system 100. The VOUT simulation response 404 shows time values in nanoseconds (nS) on the X-axis, and voltage values in volts on the Y-axis. The VOUT simulation response 404 includes plots 412 and 414 depicting simulation results of system 100 during normal operation. In this example, plot 412 shows a desired (e.g., predetermined, programmed) VOUT output voltage value of 0.9 volts and plot 414 shows VOUT voltage response during periodic activity of load circuit 106. By way of example, operation of the dual loop LDO system 100 is depicted in the following time steps.

At time t1, an active cycle of operation begins. Control signal CS2 from the load circuit 106 transitions to a logic high level indicating that the load circuit 106 (e.g., capacitive DAC of an SAR ADC) is active. When active, the load circuit 106 begins drawing current (e.g., switching activity of sample and evaluation phases of the capacitive DAC). During periods of active current draw (e.g., from time t1 to time t3), the second operational amplifier 104 sources current to the load circuit 106. When the second operational amplifier 104 sources an amount of current at or beyond a predetermined threshold, the CS1 signal transitions to a logic high level (e.g., at time t1) providing a fast loop active indication. In this example, the CSOUT signal is a logical OR of the CS1 and CS2 control signals. Accordingly, the CSOUT signal transitions to a logic high level (e.g., at time t1) when the CS1 signal or the CS2 signal transitions to a logic high level. When the CSOUT signal is at a logic high level, the switch circuit 110 is opened resulting in an open circuit in feedback path 116. Capacitor 112 coupled at the inverting input first amplifier stage 102 holds a voltage level while the switch circuit 110 is open. Because the amount of current drawn by the load circuit 106 is momentarily greater than the amount of current sourced by the second amplifier stage 104, the VOUT voltage dips slightly (e.g., about 60 millivolts).

At time t2, the load circuit 106 becomes inactive (e.g., sample and evaluation phases of the capacitive DAC are completed) and the CS2 signal transitions to a logic low level. When the load circuit 106 becomes inactive the VOUT voltage begins to recover toward the desired VOUT voltage value. Because of the capacitive nature of the load circuit 106, current continues to be sourced by the second operational amplifier 104 as the VOUT voltage recovers.

At time t3, as the VOUT voltage settles near the desired VOUT voltage value (e.g., VOUT within 10% of the desired VOUT voltage value), the CS1 signal transitions to a logic low level indicating that the second amplifier stage 104 is sourcing current below the predetermined threshold. Accordingly, the CSOUT signal transitions to a logic low level. When the CSOUT signal is at a logic low level, the switch circuit 110 is closed completing the feedback path 116 from VOUT to the second input of the first amplifier stages and a resulting V1 voltage signal is provided to the second amplifier stage 104 allowing for accurate return of the VOUT voltage to the desired VOUT voltage value.

At time t4, the next active cycle of operation begins. Control signals CS1 and CS2 each transition to a logic high level indicating that the load circuit 106 is active and the second amplifier stage 104 is sourcing current. In turn, CSOUT transitions to a logic high level causing switch circuit 110 to open which results in an open circuit in feedback path 116. The cycle continues as described at times t1 through t3.

Generally, there is provided, an LDO regulator system including a first amplifier circuit having a first input coupled to receive a reference voltage and an output; a second amplifier circuit having a first input coupled to the output of the first amplifier, the second amplifier circuit configured to provide at a first output a predetermined voltage; and a switch circuit coupled between the first output of the second amplifier circuit and a second input of the first amplifier circuit, the switch circuit configured to cause an open circuit in a first feedback path from the first output of the second amplifier circuit to the second input of the first amplifier circuit based on a control signal. The first output of the second amplifier circuit may be coupled directly to a second input of the second amplifier circuit forming a second feedback path. The system may further include a capacitor coupled at the second input of the first amplifier circuit. The system may further include a load circuit coupled to the first output of the second amplifier circuit, the load circuit configured to provide a first active indication signal when the load circuit is active. The load circuit may include a capacitive digital-to-analog converter (DAC). The second amplifier circuit may further include a detection circuit configured to provide a second active indication signal at a second output when at least a predetermined amount of current is being sourced by the second amplifier circuit. The switch circuit may be configured to cause the first feedback path to have continuity from the first output of the second amplifier circuit to the second input of the first amplifier circuit when the predetermined voltage is provided at the first output. The system may further include a control circuit coupled to provide the control signal to the switch circuit, the control circuit coupled to receive the first active indication signal and the second active indication signal. The switch circuit may include a P-channel transistor coupled to receive the control signal.

In another embodiment, there is provided, an LDO regulator system including a first amplifier circuit having a first input coupled to receive a reference voltage and an output; a second amplifier circuit having a first input coupled to the output of the first amplifier, the second amplifier circuit configured to provide at a first output a predetermined voltage; and a switch circuit coupled to receive a control signal, the switch circuit configured to complete a first feedback path from the first output of the second amplifier circuit to a second input of the first amplifier circuit when the control signal is at a first state and to form an open circuit in the first feedback path when the control signal is at a second state. The system may further include a capacitor coupled at the second input of the first amplifier circuit. The first output of the second amplifier circuit may be coupled directly to a second input of the second amplifier circuit forming a second feedback path. The system may further include a load circuit coupled to the first output of the second amplifier circuit, the load circuit configured to provide an active indication signal when the load circuit is active. The load circuit may include a capacitive digital-to-analog converter (DAC). The second amplifier circuit may further include a detection circuit configured to provide an active indication signal at a second output when an amount of current sourced by the second amplifier circuit exceeds a predetermined threshold. The system may further include a control circuit coupled to provide the control signal to the switch circuit.

In yet another embodiment, there is provided, an LDO regulator system including a slow loop amplifier circuit having a first input coupled to receive a reference voltage and an output; a fast loop amplifier circuit having a first input coupled to the output of the first amplifier, the fast loop amplifier circuit configured to provide at a first output a predetermined voltage; and a switch circuit configured to complete a first feedback loop from the first output of the fast loop amplifier circuit to a second input of the slow loop amplifier circuit when the fast loop amplifier circuit is not sourcing at least a predetermined amount of current. The system may further include a capacitor coupled at the second input of the slow loop amplifier circuit. The first output of the fast loop amplifier circuit may be coupled directly to a second input of the fast loop amplifier circuit forming a second feedback loop. The system may further include a load circuit coupled to the first output of the fast loop amplifier circuit, the load circuit characterized as a capacitive digital-to-analog converter (DAC).

By now it should be appreciated that there has been provided, a dual loop LDO regulator system having a feedback path conditionally enabled. The dual loop LDO provides a predetermined output voltage and includes a fast loop for fast settling of the output voltage and a slow loop for accurately setting the output voltage. The slow loop incorporates a switch circuit in the feedback path which is enabled when the output voltage is within a predetermined range of the predetermined output voltage value allowing the fast loop to be optimized for speed while providing an accurate output voltage.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

The term "coupled," as used herein, is not intended to be limited to a direct coupling or a mechanical coupling.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. An LDO regulator system comprising:

a first amplifier circuit having a first input coupled to receive a reference voltage and an output;

a second amplifier circuit having a first input coupled to the output of the first amplifier, the second amplifier circuit configured to provide at a first output a predetermined voltage, the first output of the second amplifier circuit coupled directly to a second input of the second amplifier circuit forming a first feedback path; and a switch circuit coupled between the first output of the second amplifier circuit and a second input of the first amplifier circuit, the switch circuit configured to cause an open circuit in a second feedback path from the first output of the second amplifier circuit to the second input of the first amplifier circuit based on a control signal.

2. The system of claim 1, further comprising a capacitor coupled at the second input of the first amplifier circuit.

3. The system of claim 1, further comprising a load circuit coupled to the first output of the second amplifier circuit, the load circuit configured to provide a first active indication signal when the load circuit is active.

4. The system of claim 3, wherein the load circuit comprises a capacitive digital-to-analog converter (DAC).

5. The system of claim 3, wherein the second amplifier circuit further comprises a detection circuit configured to provide a second active indication signal at a second output when at least a predetermined amount of current is being sourced by the second amplifier circuit.

6. The system of claim 5, wherein the switch circuit is configured to cause the second feedback path to have continuity from the first output of the second amplifier circuit to the second input of the first amplifier circuit when the predetermined voltage is provided at the first output.

7. The system of claim 5, further comprising a control circuit coupled to provide the control signal to the switch circuit, the control circuit coupled to receive the first active indication signal and the second active indication signal.

8. The system of claim 1, wherein the switch circuit comprises a P-channel transistor coupled to receive the control signal.

9. An LDO regulator system comprising:

a first amplifier circuit having a first input coupled to receive a reference voltage and an output;

a capacitor coupled at the second input of the first amplifier circuit;

a second amplifier circuit having a first input coupled to the output of the first amplifier, the second amplifier circuit configured to provide at a first output a predetermined voltage; and a switch circuit coupled to receive a control signal, the switch circuit configured to complete a first feedback path from the first output of the second amplifier circuit to a second input of the first amplifier circuit when the control signal is at a first state and to form an open circuit in the first feedback path when the control signal is at a second state.

10. The system of claim 9, wherein the first output of the second amplifier circuit is coupled directly to a second input of the second amplifier circuit forming a second feedback path.

11. The system of claim 9, further comprising a load circuit coupled to the first output of the second amplifier circuit, the load circuit configured to provide an active indication signal when the load circuit is active.

12. The system of claim 11, wherein the load circuit comprises a capacitive digital-to-analog converter (DAC).

13. The system of claim 9, wherein the second amplifier circuit further comprises a detection circuit configured to provide an active indication signal at a second output when an amount of current sourced by the second amplifier circuit exceeds a predetermined threshold.

14. The system of claim 9, further comprising a control circuit coupled to provide the control signal to the switch circuit.

15. An LDO regulator system comprising:

a slow loop amplifier circuit having a first input coupled to receive a reference voltage and an output;

a fast loop amplifier circuit having a first input coupled to the output of the first amplifier, the fast loop amplifier circuit configured to provide at a first output a predetermined voltage, the first output of the fast loop amplifier circuit is coupled directly to a second input of the fast loop amplifier circuit forming a second feedback loop; and a switch circuit configured to complete a first feedback loop from the first output of the fast loop amplifier circuit to a second input of the slow loop amplifier circuit when the fast loop amplifier circuit is not sourcing at least a predetermined amount of current.

16. The system of claim 15, further comprising a capacitor coupled at the second input of the slow loop amplifier circuit.

17. The system of claim 15, further comprising a load circuit coupled to the first output of the fast loop amplifier circuit, the load circuit characterized as a capacitive digital-to-analog converter (DAC).

18. An LDO regulator system comprising:

a first amplifier circuit having a first input coupled to receive a reference voltage and an output;

a capacitor coupled at a second input of the first amplifier circuit;

a second amplifier circuit having a first input coupled to the output of the first amplifier, the second amplifier circuit configured to provide at a first output a predetermined voltage; and a switch circuit coupled between the first output of the second amplifier circuit and the second input of the first amplifier circuit, the switch circuit configured to cause an open circuit in a first feedback path from the first output of the second amplifier circuit to the second input of the first amplifier circuit based on a control signal.

19. An LDO regulator system comprising:

a first amplifier circuit having a first input coupled to receive a reference voltage and an output;

a second amplifier circuit having a first input coupled to the output of the first amplifier, the second amplifier circuit configured to provide at a first output a predetermined voltage, the first output of the second amplifier circuit coupled directly to a second input of the second amplifier circuit forming a first feedback path; and a switch circuit coupled to receive a control signal, the switch circuit configured to complete a second feedback path from the first output of the second amplifier circuit to a second input of the first amplifier circuit when the control signal is at a first state and to form an open circuit in the second feedback path when the control signal is at a second state.

20. An LDO regulator system comprising:

a slow loop amplifier circuit having a first input coupled to receive a reference voltage and an output;

a capacitor coupled at the second input of the slow loop amplifier circuit;

a fast loop amplifier circuit having a first input coupled to the output of the first amplifier, the fast loop amplifier circuit configured to provide at a first output a predetermined voltage; and a switch circuit configured to complete a first feedback loop from the first output of the fast loop amplifier circuit to a second input of the slow loop amplifier circuit when the fast loop amplifier circuit is not sourcing at least a predetermined amount of current.

* * * * *